US006782110B1

(12) United States Patent
Sigwanz et al.

(10) Patent No.: US 6,782,110 B1
(45) Date of Patent: Aug. 24, 2004

(54) METHOD AND DIGITAL HEARING DEVICE FOR DETECTING AND/OR REMOVING ERRORS ARISING IN THE TRANSMISSION AND STORAGE OF DATA

(75) Inventors: Ullrich Sigwanz, Hausen (DE); Fred Zoels, Altenthann (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/132,017

(22) Filed: Aug. 10, 1998

(30) Foreign Application Priority Data

Aug. 11, 1997 (DE) ..... 197 34 723

(51) Int. Cl.[7] ..... H04R 25/00

(52) U.S. Cl. ..... 381/312; 380/60; 380/314; 380/323; 714/6; 714/18

(58) Field of Search ..... 381/314, 60, 312, 381/320, 323, 321; 714/18, 25, 30, 48, 54, 1, 164, 176, 742, 733, 734, 712, 6, 777

(56) References Cited

U.S. PATENT DOCUMENTS 4,049,930 A * 9/1977 Fletcher
4,989,251 A * 1/1991 Mangold
5,217,011 A 6/1993 Bisch
5,604,812 A * 2/1997 Meyer
5,910,997 A 6/1999 Ishige et al.
6,108,431 A * 8/2000 Bachler

FOREIGN PATENT DOCUMENTS

| | | |
|---|---|---|
| DE | 35 27 112 | 1/1987 |
| DE | 195 41 648 | 5/1997 |
| EP | 0 341 903 | 5/1989 |

* cited by examiner

*Primary Examiner*—Huyen Le
*Assistant Examiner*—Dionne Harvey
(74) *Attorney, Agent, or Firm*—Schiff Hardin LLP

(57) ABSTRACT

In a method for detecting and/or removing errors in the transmission and storage of data in a digital hearing device and a digital hearing device operating according to the method, an internal check of transmitted and stored data occurs within the hearing device itself. The digital hearing device has an input transducer, an output transducer, a processor and a program memory, with a checking element for internal checking of transmitted and stored data within the hearing device, being connected at least to the program memory and the processor.

20 Claims, 5 Drawing Sheets

METHOD AND DIGITAL HEARING DEVICE FOR DETECTING AND/OR REMOVING ERRORS ARISING IN THE TRANSMISSION AND STORAGE OF DATA

BACKGROUND OF THE INVENTION

1. Field of the Invention

The present invention relates to a method for detecting and/or removing errors in the transmission and storage of data in a digital/digitally programmable hearing device, and to a hearing device operating in accordance with the method.

2. Description of the Prior Art

European Application 0 341 903 teaches a method for programming a hearing device in which in the data transmission data are programmed into a hearing device from a host computer via an interface, with a check of the data transmitted by the host computer taking place in the interface.

An error check of the data transmitted to the hearing device from the interface does not occur, however.

SUMMARY OF THE INVENTION

An object of the present invention is to provide a method and a digital hearing device which enables a detection and/or removal of any errors arising in connection with a hearing aid in the transmission and storage of data.

The above object is achieved in accordance with the present invention in a method and a digital hearing device wherein an internal check of the transmitted and stored data takes place within the hearing device itself.

The inventive method enables the detection of data errors which arise within the hearing device during the course of storage and/or data transmission procedures. Data errors which arise in the hearing aid subsequent to a correct data transmission (possibly from a host computer via an interface) can thus be detected.

Substantially continuous data storage procedures (routines) and data transmission procedures (routines) occur during the operation of a digital/digitally programmable hearing device. Data errors which may occur arising therein are detected by the internal check of the inventive method inside the hearing aid.

In particular, data errors arising in the data transmission between a secondary memory and the main memory are detected by the inventive method. In the operation of a digital hearing device new programs are continuously loaded from a secondary memory into the main memory or from the main memory into the processing unit, so that data errors also can arise in such transmissions with a relatively high probability.

In a further variation the inventive method enables the monitoring of the stability of the data stored in the main memory and/or a secondary memory as well as the detection of undesirable alterations of the stored data.

Data, or data words, stored in the registers of the processor can also be monitored for data stability through the inventive method.

The inventive method further enables an accuracy check to be conducted for data entered by the user(whether by keystroke or programming).

The checking of transmitted and stored data preferably occurs in definable and particularly periodic intervals, so that a high level of data security can be thereby achieved with a justifiable computing outlay.

In an embodiment of the method the frequency of the checking of the transmitted and stored data is determined by the type of data. By means of an integrated decision program it can be determined the priority that the individual data have (e.g. with respect to the comfort or the security for the user) in order to make more frequent checks for data transmission procedures or storage procedures involving data accorded a particularly high priority. A concentration on particularly significant data thus can occur, such data consequently being checked with increased frequency.

By undertaking a data check in the startup/changeover of the hearing aid, the particularly sensitive conditions of the reloading of programs and the initialization (start-up) of the hearing device can be checked, these being particularly susceptible to data errors.

The inventive method offers a particular advantage in the checking of data in connection with a hearing device which functions with an internal digital signal processor (DSP).

In such DSP hearing devices a completely new output signal is generated without direct reliance on the input signal, by means of the received and loaded programs.. The received input signal is analyzed in the DSP and a new output signal is generated via computing processes and programs to be loaded.

Data errors which arise therein can cause discomfort or even hearing damage to the patient due to the generation of an erroneous output signal.

The inventive method enables the avoidance of such miscalculations of the output signal arising in the generation of the output signal due to data errors in the transmission and storage of data.

To check the transmitted and stored data in the context of the inventive method, a parity check can be employed, and it can be determined on the basis of the status of the parity bit whether a data error is present.

In a more expensive form of data checking in the context of the invention, checksums are formed, which allow a greater number of data errors to be detected in comparison to a pure parity check.

Another alternative in the context of the inventive method is to undertake a data check according to a Hamming code technique. This enables a detection and localization of individual data errors so that a focussed removal of the data errors can take place.

After a data error has been detected the erroneous bit can be changed into its correct status again by reversing its logic level. The data error is thereby removed, and there can be further processing within the hearing device with the corrected data record.

For security an automatic shutoff of the hearing device can occur upon the detection of a data error. Dependent on the classification of the checked data (e.g. according to comfort or security aspects, as previously described), upon the occurrence of a data error a response can be made according to the priority of the checked data, such as reversal of the erroneous bit, producing an optical/acoustical display (to allow for manual intervention) or an automatic shutoff of the hearing device.

Particularly in digital hearing devices with a digital signal processor it is advantageous to cause a restart of the program execution given detection of a data error, whereby on the basis of the newly occurring loading of the program (e.g. from the secondary memory into the main memory) there is a renewed data transmission with the possibility of avoidance of the data error.

The inventive digital hearing device can detect arising data errors by means of an integrated checking element for making an internal check of transmitted and stored data inside the hearing device.

For conducting a static parity check, one or more parity decoders can be utilized as such a checking element. Individual data words are entered into such a parity decoder wherein the words are checked for data accuracy by the status of the parity bit.

The checking element of the digital hearing device can alternatively be a checksum unit for generating a checksum from the data record (and comparison with the correct sum). A more costly, but also more precise detection of data errors compared to the parity decoder can then occur by supplying the result to an executive control unit in connection to the checksum unit.

In another embodiment the checking element employs the Hamming code method, which enables a precise localization of individual data errors and thus a simple removal of these errors.

In another embodiment the inventive digital hearing device contains a number of checking elements working according to different principles (e.g. a parity check decoder and a checksum unit and unit according to the Hamming code method) in order to be able to execute data error detection with precision commensurate with the type (priority) of the data being checked.

Since the checking element is connected with the program memory and/or with the processor of the digital hearing device, data errors arising in connection with these components of the digital hearing device can also be detected.

In another embodiment the checking element is connected with at least one operating key and/or with an interface terminal. Data introduced into the digital hearing device via interfaces thus can be checked for accuracy as well. In the transmission of data proceeding from a host computer via an interface a data security check initiated in an interface can be canceled and taken over by the checking element integrated in the digital hearing device.

DESCRIPTION OF THE PREFERRED EMBODIMENTS

Figure 1:
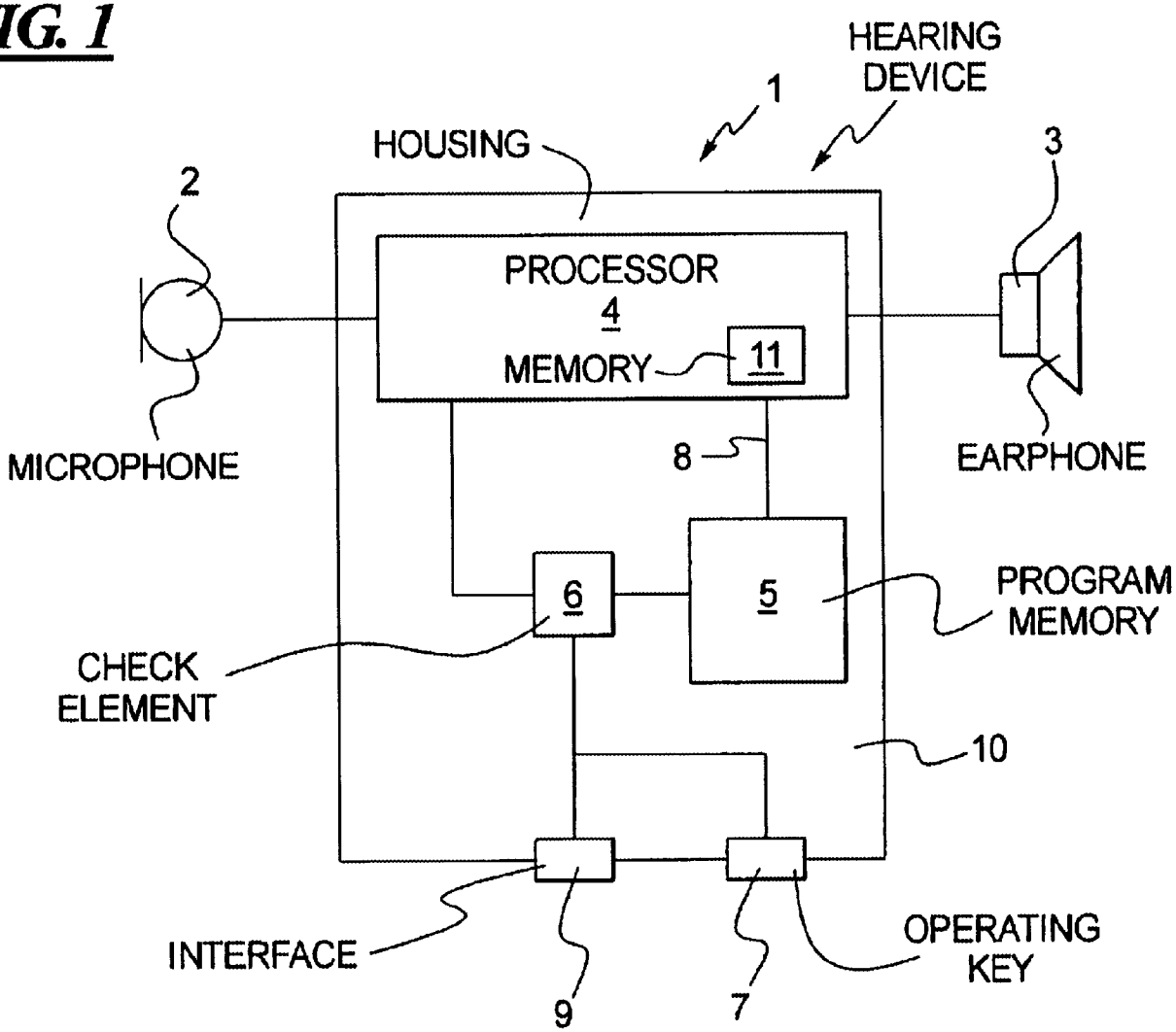
FIG. 1 is a schematic block diagram of a digital hearing device constructed and operating in accordance with the principles of the present invention.

FIG. 1 shows a digital/digitally programmable hearing device 1 having a housing 10 containing a microphone 2 as an acousto-electrical input transducer (or a hearing coil, not depicted) and an earphone 3 as an electro-acoustical output transducer. The input signal is transformed—with corresponding analysis and processing—by the microphone 2 into an output signal—for output at the earphone 3—in a processor 4 in the housing 10 of the hearing device 1.

Various programs are loaded from the program memory 5 into the processor 4 (which preferably is a digital signal processor) in order to effect processing of the input signal and generation of a new output signal. Running data transmissions between the program memory 5 and the processor 4 thus take place. A checking element 6 serves for checking the data integrity, as described above, this element 6 being connected between the program memory 5 and the processor 4. Depending on the type of data, data not checked by the checking element 6 also can be exchanged via a direct connection 8 between processor 4 and program memory 5.

Data fed into the hearing device 1 via a operating key 7 and/or the interface terminal 9 are likewise checked for data security by the checking element 6.

An interface (not shown) connected at the interface terminal 9 can be utilized without a data integrity check being made in the interface.

The checking element 6 thus serves for comprehensive data transmission of data transmitted and stored within the hearing device 1 and can additionally check data for correctness which were entered into the hearing device 1 rom the outside via interfaces (here the operating key 7 and the interface terminal 9).

As also shown in FIG. 1, the hearing device 1 includes a memory 11 having data stored therein, with the aforementioned transmitted data being transmitted between the memory 11 and the program memory 5. The check element 6 can conduct an internal check of the data transmitted between the program memory 5 and the memory 11 as well.

Figure 2:
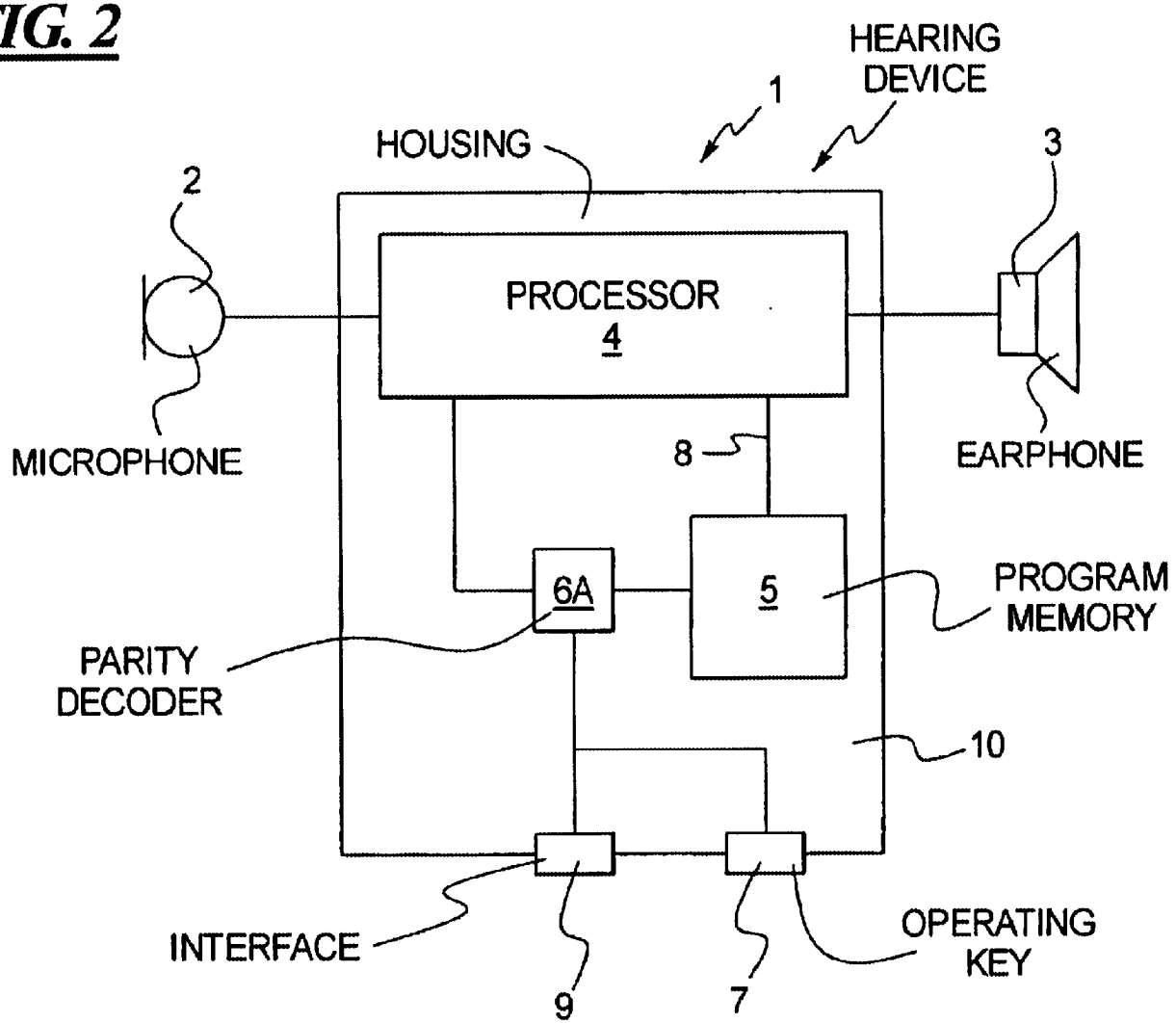
FIG. 2 is a schematic block diagram of an embodiment of the digital hearing device in accordance with the invention wherein the check element is a parity decoder.
Figure 3:
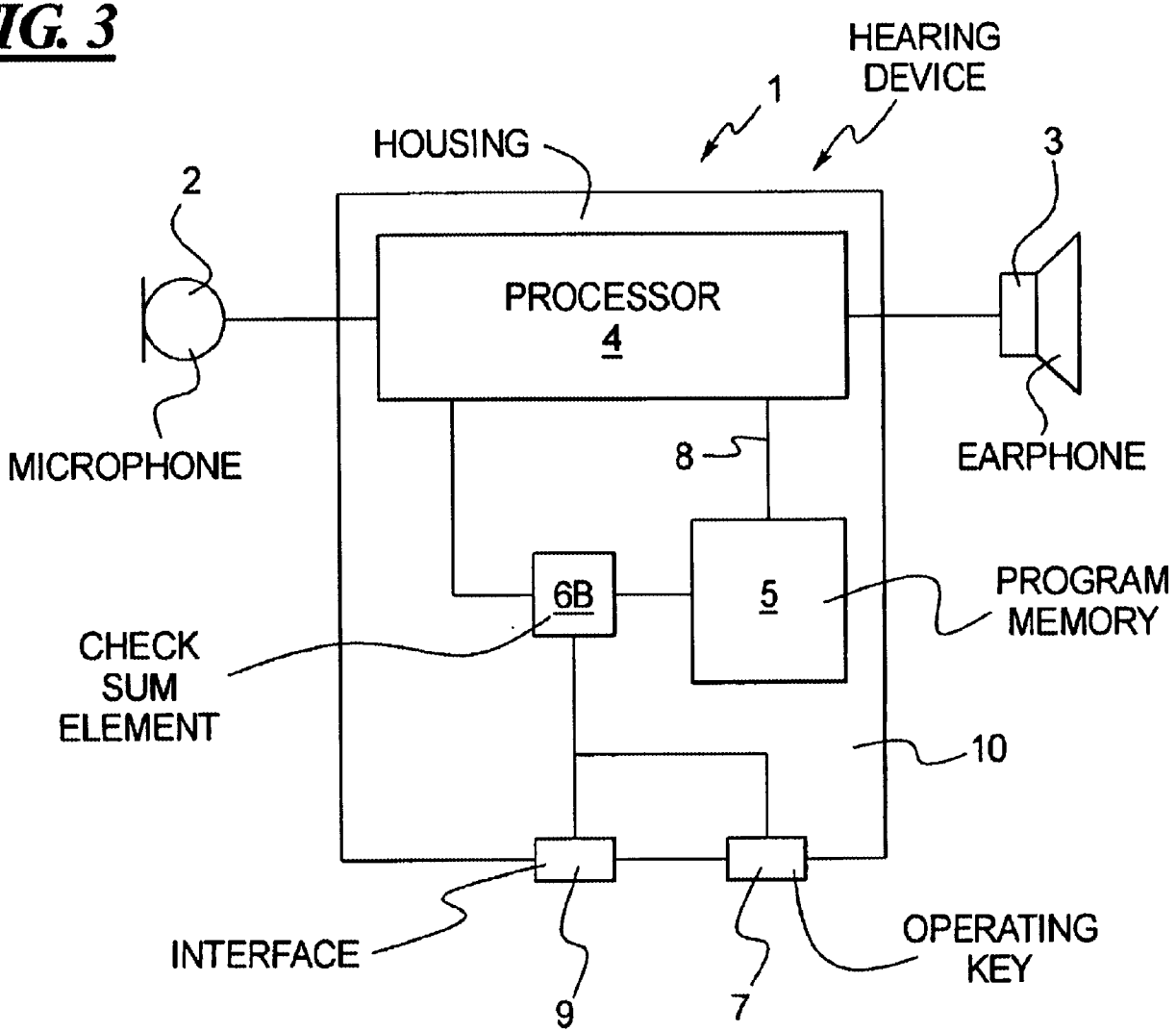
FIG. 3 is a schematic block diagram of an embodiment of a digital hearing device in accordance with the invention wherein the check element is a checksum element.
Figure 4:
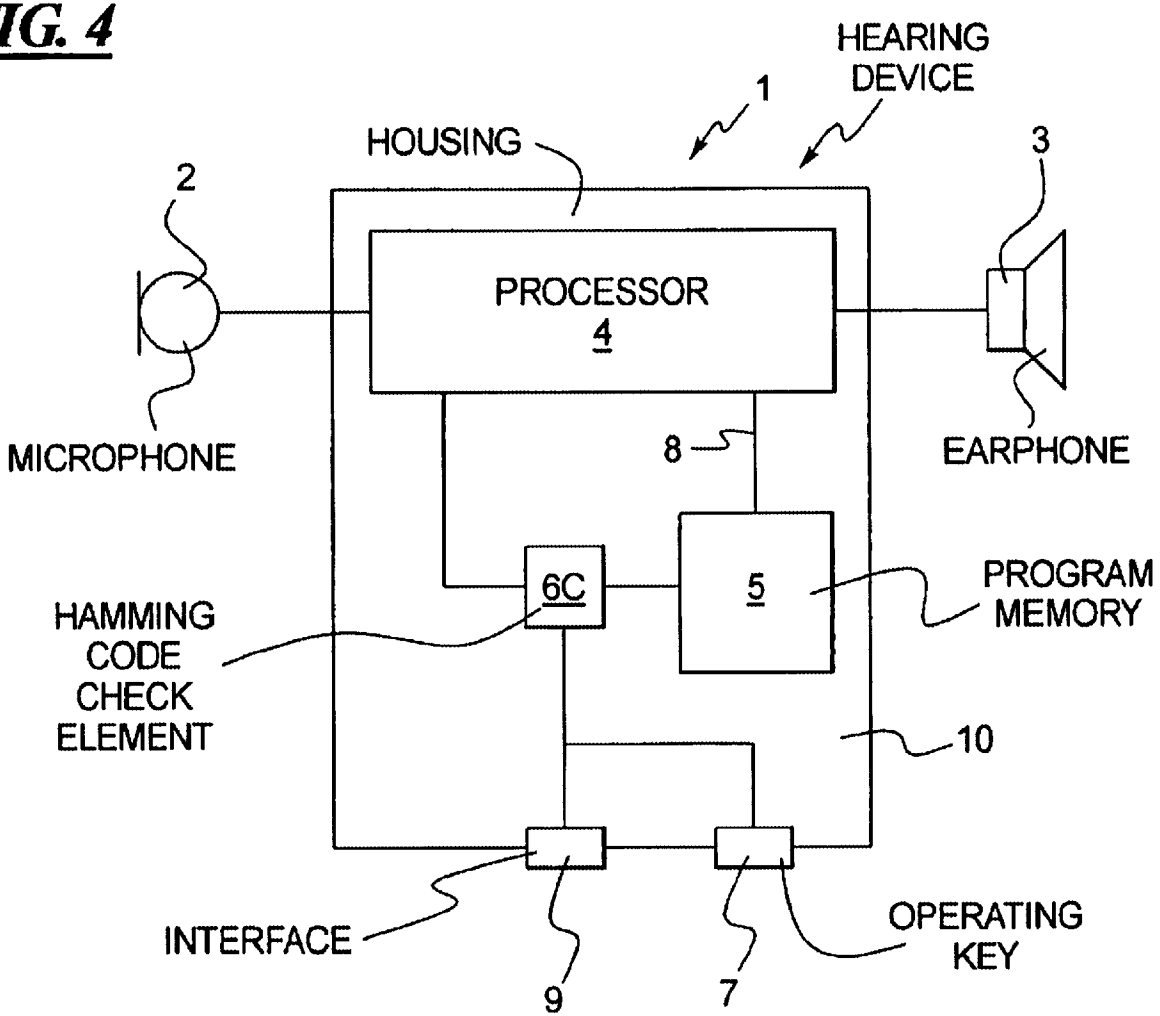
FIG. 4 is a schematic block diagram of an embodiment of the digital hearing device in accordance with the invention wherein the check element is a Hamming code check element.
Figure 5:
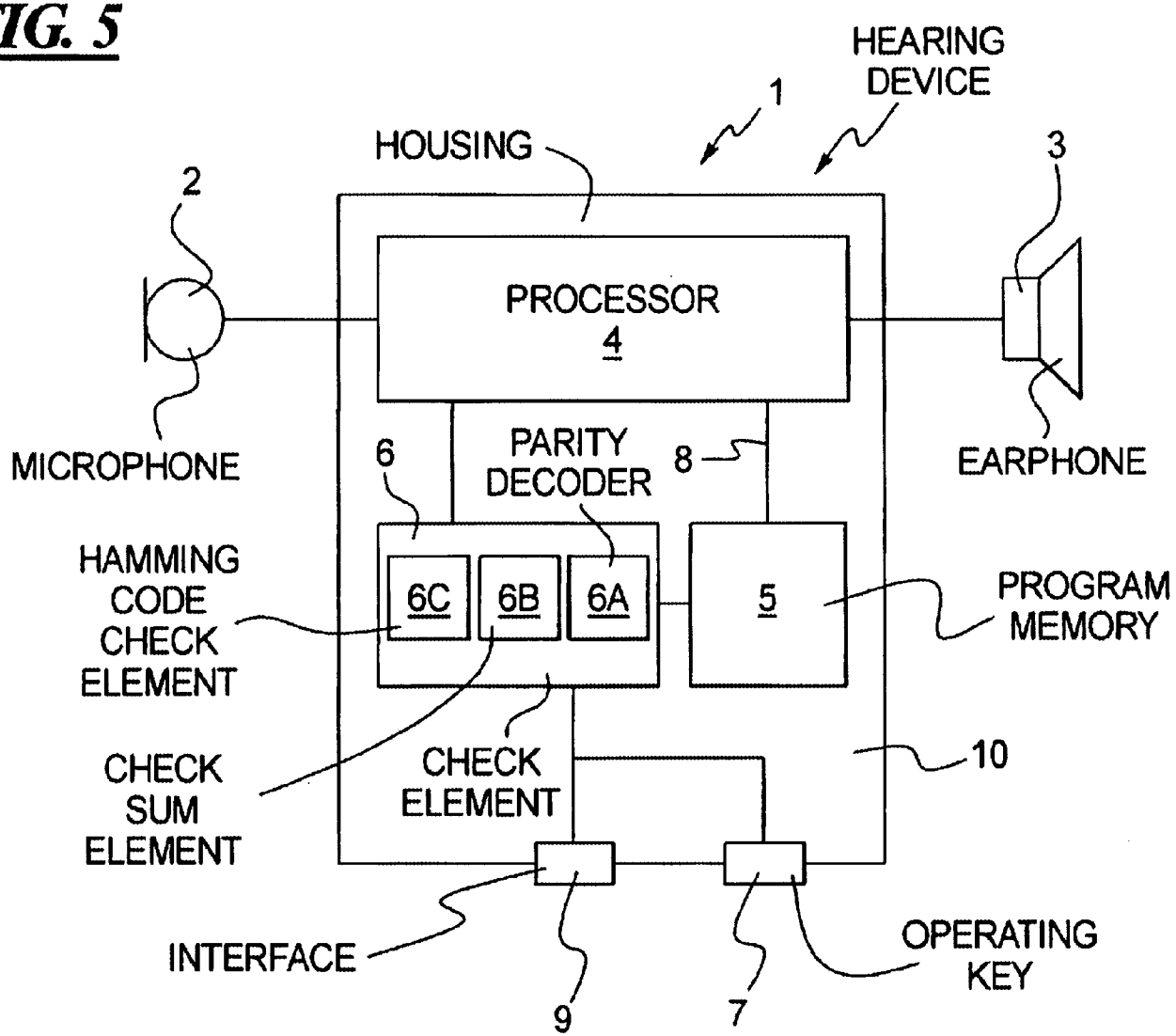
FIG. 5 is a schematic block diagram of an embodiment of a digital hearing device in accordance with the invention wherein the check element is composed of a number of differently operating check elements.

The check element 6 may be a parity decoder 6A as shown in FIG. 2 or a checksum element 6B as shown in FIG. 3 or a Hamming code check element 6C as shown in FIG. 4. Moreover, as shown in FIG. 5, the check element 6 may include a number of separate checking elements respectively operating according to different checking principals, such as two or more of the parity decoder 6A, the check sum element 6B and/or the Hamming code check element 6C.

Although various minor modifications might be suggested by those skilled in the art, it should be understood that our wish to embody within the scope of the patent warranted hereon all such modifications as reasonably and properly come with the scope of our contribution to the art.

What is claimed is:

1. A method for detecting and removing errors in transmitted data and stored data in a digital hearing device, comprising the steps of:

providing a hearing aid having a hearing aid housing containing components operating on the basis of transmitted data comprised of bits transmitted exclusively via a plurality of signal lines within said hearing and stored data comprised of bits stored exclusively within said hearing aid; and conducting an internal check exclusively within said hearing aid housing of said transmitted data and stored data to identify bit errors therein arising due to either faulty transmission of a bit of said transmission data transmitted via a signal line among said plurality of signal lines or faulty storage of a bit of said stored data within said hearing aid housing.

2. A method as claimed in claim 1 wherein said hearing aid device comprises a main memory having stored data therein and a secondary memory having stored data therein, with transmitted data being transmitted between said secondary memory and said main memory, and wherein the step of conducting an internal check comprises conducting an internal check of the transmitted data between said main memory and said secondary memory.

3. A method as claimed in claim 2 wherein the step of conducting an internal check comprises conducting an internal check of the stored data in said main memory.

4. A method as claimed in claim 2 wherein the step of conducting an internal check comprises conducting an internal check of the stored data in said second memory.

5. A method as claimed in claim 1 wherein said hearing aid comprises a processor having a register with stored data therein, and wherein the step of conducting an internal check comprises conducting an internal check of the stored data in said register of said processor.

6. A method as claimed in claim 1 wherein the step of conducting an internal check comprises conducting an internal check of said transmitted data and said stored data at defined intervals.

7. A method as claimed in claim 6 wherein said transmitted data and said stored data comprise data having a plurality of different priority levels, and wherein the step of conducting an internal check comprises conducting an internal check of the data having respectively different levels at different intervals dependent on the level of the data.

8. A method as claimed in claim 1 wherein said hearing device is operated with a start-up procedure, and wherein the step of conducting an internal check comprises conducting an internal check of the transmitted data and the stored data during start-up of the hearing device.

9. A method as claimed in claim 1 wherein said hearing device contains a digital signal processor, and wherein the step of conducting an internal check is made using said digital signal processor.

10. A method as claimed in claim 1 wherein the step of conducting an internal check comprises conducting a parity check of said transmitted data and said stored data.

11. A method as claimed in claim 1 wherein the step of conducting an internal check comprises forming a checksum of said transmitted data and said stored data.

12. A method as claimed in claim 1 wherein the step of conducting an internal check comprises employing a Hamming code to internally check said transmitted data and said stored data.

13. A method as claimed in claim 1 wherein the step of conducting an internal check identifies an erroneous bit having a logic level, and wherein said method comprises the additional step of reversing the logic level of said erroneous bit upon detection thereof.

14. A method as claimed in claim 1 comprising the additional step of, upon detection of a data error in the step of conducting an internal check, shutting down operation of said hearing device.

15. A method as claimed in claim 1 wherein said hearing aid operates by executing an operating program, and comprising the additional step of, upon detection of an error in the step of conducting an internal check, automatically restarting said operating program.

16. A digital programmable hearing device comprising:

a housing containing an input transducer and an output transducer with a signal path therebetween;

a signal processor connected in said housing in said signal path;

a program memory communicating with said signal processor, said program memory and said signal processor operating on the basis of transmitted data comprised of bits transmitted exclusively via a plurality of signal lines within said housing and stored data comprised of bits stored exclusively within said housing; and a check element in said housing, communicating with at least one of said processor and said program memory, for internally checking, exclusively within said housing, said transmitted data and said stored data to identify bit errors therein arising due to either faulty transmission of a bit of said transmitted data transmitted via a signal line among said plurality of signal lines or faulty storage of a bit of said stored data within said hearing aid housing.

17. A digital programmable hearing device as claimed in claim 16 wherein said checking means comprises a parity decoder.

18. A digital programmable hearing device as claimed in claim 16 wherein said checking means comprises a check sum unit.

19. A digital programmable hearing device as claimed in claim 16 wherein said checking means comprises a Hamming code checking element.

20. A digital programmable hearing device as claimed in claim 16 wherein said checking means comprises a plurality of separate checking elements respectively operating according to different checking principles.

* * * * *